United States Patent [19]

Hayes et al.

[11] Patent Number: 5,012,828

[45] Date of Patent: May 7, 1991

[54] TOBACCO SMOKE FILTER CONTAINING PARTICULATE ADDITIVE

[76] Inventors: Ernest B. Hayes, 14 Heath Court, Leighton Buzzard LU7 7JR, Bedfordshire; Paul F. Clarke, 39 Horsley Hill Road, South Shields, Tyne & Wear, both of England

[21] Appl. No.: 415,049

[22] Filed: Sep. 29, 1989

[30] Foreign Application Priority Data

Oct. 5, 1988 [GB] United Kingdom ..... 8823388

[51] Int. Cl.[5] ..... A24D 3/00; A24D 3/02; A24D 3/04

[52] U.S. Cl. ..... 131/341; 131/342; 131/343; 131/344; 493/47; 493/49

[58] Field of Search ..... 131/342, 331, 343, 336, 131/344, 335; 493/46, 47, 49

[56] References Cited

U.S. PATENT DOCUMENTS

| | | | |
|---|---|---|---|
| 4,770,193 | 9/1988 | Pryor | 131/342 |
| 4,811,745 | 3/1989 | Cohen | 131/342 |

FOREIGN PATENT DOCUMENTS

| | | |
|---|---|---|
| 1037435 | 12/1967 | United Kingdom . |
| 1045826 | 2/1968 | United Kingdom . |
| 1073896 | 8/1968 | United Kingdom . |
| 1121474 | 12/1968 | United Kingdom . |
| 1145976 | 4/1969 | United Kingdom . |

*Primary Examiner*—V. Millin

*Attorney, Agent, or Firm*—Scully, Scott, Murphy & Presser

[57] ABSTRACT

A tobacco smoke filter comprising a rod of tobacco smoke filtering material incorporating particulate additive, wherein at least some of the particulate additive is concentrated on one or a restricted number of threads and/or strips incorporated within the remaining body of filtering material, the additive adhering to said thread(s) and/or strip(s).

12 Claims, No Drawings

TOBACCO SMOKE FILTER CONTAINING PARTICULATE ADDITIVE

This invention relates to tobacco smoke filters containing particulate additive—e.g. sorbents such as activated carbon, silica gel, sepiolite, alumina, ion exchangers, etc.

The various prior procedures for manufacturing such filters have suffered from one or more of production problems, problems of control over product quality and uniformity, and problems of machinery wear.

According to the invention, at least some of the particulate additive is concentrated on one or a restricted number of threads and/or strips incorporated within the remaining body of filtering material, the additive adhering to said thread(s) and/or strip(s). Preferably at least the majority of the particulate additive in the filter is carried by the said thread(s) and/or strip(s); most preferably all of the particulate additive is so carried, though it is possible for the filter to contain some particulate additive which is not located on the thread(s) and/or strip(s).

The particulate additive is suitably adhered to said thread(s) and/or strip(s) by hot melt adhesive, high m.p. polyethylene glycol, or emulsion-type adhesive such as PVA.

Any particulate additive used may be a single substance or a mixture.

The additive-bearing threads and/or strips will usually extend the full length of the filter rod.

Preferably the or each additive-bearing thread or strip is coated uniformly with adhered particulate additive over its full length; however, there may be non-uniform coating, and it is possible for any such thread or strip to have a part or parts of its length carrying adhered particulate additive and another part or parts of its length carrying no particulate additive or different additive or additives; both types (full length and part length coated) may be present. Whilst a strip or thread may have different parts of its length with different particulate coatings (e.g. differing in one or more of coating weight, identity or composition, and particle size or other characteristic) it is preferred for a given thread or strip to have only a uniform particulate coating (whether full or part length). The particulate coating(s) on one strip or thread may differ from the coating(s) on another strip or thread.

Where there are two or more particulate additive-bearing threads and/or strips they may be distributed across the filter section, or may be grouped together to form an additive-containing core or cores within the body of the rest of the filter medium; such a core can advantageously provide a path through the filter of lower pressure drop than that of the rest of the filter—thus increasing the smoke flow in contact with the additive. Such a core may be enclosed in a sleeve, e.g. of plastics film or conventional plugwrap; such a sleeve may be of air-permeable or -impermeable material and may be perforate. A core with a sleeve will usually be a preformed item.

The filter body incorporating the particulate additive-carrying thread(s) and/or strip(s) may be of material which is conventional for the formation of tobacco smoke (e.g. cigarette) filters; thus it may be of staple fibres or of filamentary tow (in either case suitably of cellulose acetate) or it may be of creped paper.

Where the additive is adhered to a thread or threads the latter will usually be coarser than fibres (e.g. staple fibres or filamentary tow) forming the remaining filter body. The filter body could instead be of other conventional material, e.g. creped paper.

In one manufacturing method according to the invention filter material (preferably filamentary tow) is gathered and formed into tubular form (e.g. by means of a garniture having a central mandrel) and one or more threads and/or strips with particulate additive adhered thereto are fed into the central passage (e.g. via a central bore through the mandrel) to form a core as or after the tube is formed, the resulting continuously produced rod being cut into finite lengths. The additive-containing core may provide a lower pressure drop path through the filter than the surrounding annular portion; to this end one may use core threads which are coarser and/or less densely packed than filaments forming the surrounding tube. A preformed core of the additive-carrying threads or strips within a containing sleeve may be fed through the mandrel.

In another method according to the invention filter material (e.g. staple fibre, filamentary tow, creped paper or other conventional filter material) is gathered into rod form, one or more threads and/or strips with particulate additive adhered thereto being entrained with the filter material as or before rod formation occurs—e.g. by means of a conventional garniture.

In these methods according to the invention the supply of the filter material and additive-carrying thread(s) and/or strip(s), their gathering and formation into rod or cored tube form, and cutting of the resulting elongate product into finite lengths, can be conducted continuously and in-line using conventional filter manufacturing machinery. The filter material may be bonded as it is gathered and formed, to give a product which is dimensionally stable without a plugwrap; a plugwrap can be continuously supplied and enveloped around the filter as it is formed if necessary or desired.

The thread(s) and/or strip(s) may be coated with adhesive (e.g. by drawing through a bath or other supply of the active adhesive) and then with additive (e.g. by drawing through a reservoir, fluidised bed, circulated stream or other supply of the particulate additive whilst the adhesive is active) as part of the above in-line continuous process; instead adhesive-coated thread(s) and/or strip(s) may be separately produced or obtained from an outside supplier, with activation (e.g. heat-softening) of the adhesive and application of additive being conducted in-line and continuously with filter production. Uniform application of adhesive (e.g. from a bath of PVA liquid) may be ensured by doctoring, e.g. through an orifice or past or between a blade or blades. The loading of particulate additive onto the adhesive coated, thread or strip will usually be the maximum possible, this depending on factors such as particle size, thread or strip perimeter, etc. When a wrapped core of particulate additive-carrying threads is used, the coated threads can be formed continuously as described, continuously gathered and enwrapped by a conventional in-line procedure, and the resulting sleeved core fed directly in-line to the described filter production. Less preferably, additive coated thread(s) or strip(s) can be pre-formed separately and then fed to the filter forming process (optionally via the wrapped core forming-process).

Suitable hot-melt adhesives for use in the invention are various polyester adhesives.

Additive-coated threads are preferred to strips for the purposes of the invention. From 1 to 10 threads, e.g. 1 to 4, may for example be incorporated in the filter body. The additive loading of each thread may vary widely (e.g. from 0.25 to 2.0 mg/mm), as may the total tip loading (e.g. from 25 to 100 mg for a 20 mm. length tip), according to product requirements. Tip loading can of course be controlled by selecting the number of threads and/or their loading.

Other parameters may also vary widely according to product requirements, these including for example the filament/tow denier when the filtering body is of filamentary tow, the thread denier when thread is used to carry the particulate additive, the particle size of the additive, etc. Suitable filament/tow deniers include for example 5/32,000, 5/90,000, and 2.5/45,000; a suitable additive-carrying thread is for example of about 1000 denier; one suitable particle size for activated carbon additive is 12/30 British Standard Mesh, and another is 30/70 British Standard Mesh.

The thread or strip employed according to the invention may be of any innoxious material. The thread or strip may be a textile material, e.g. one or more monofilaments, a yarn or sliver or twine, or a woven or non-woven ribbon. A suitable thread is sewing thread, notable for its uniformity. The identity of the thread is not critical, and it may be of natural and/or synthetic fibres. Rayon, nylon and polyester are materials which can be used satisfactorily for the thread, but another material is cotton, especially mercerised cotton as employed for good quality sewing thread.

The particulate additive usually is or includes a sorbent or a mixture of sorbents; at least some of the particulate additive may carry a flavourant.

The invention permits incorporation of activated carbon or other particulate additive in tobacco smoke filters using conventional apparatus without introducing production or apparatus problems and in particular with ready achievement of uniform additive loading—and simple and accurate variation of this loading when required. Filters according to the invention allow the particulate additive adhered to the thread(s) and/or strip(s) to exercise, unhindered or substantially so, its filtering effect on the tobacco smoke stream; thus filters according to the invention can give good tar, nicotine and vapour phase retentions, and good tar/nicotine retention ratios.

Filter rods according to the invention can be produced continuously and cut into finite lengths. Each individual such finite length could be used on its own as a filter for a cigarette, but is preferably employed in longitudinal alignment with at least one other filter element as part of a composite (e.g. dual or triple) cigarette filter; preferably an individual filter element according to the invention is employed in conjunction with a longitudinally aligned buccal end element of conventional appearance—e.g. a uniform plug of cellulose acetate filamentary tow.

The invention is illustrated by the following working Examples.

Examples 1 to 6 employed SC2 carbon (from Chemviron) of 12/30 British Standard Mesh size, coated onto three textile threads by means of a hot melt polyester adhesive on the threads, each thread was of about 1000 denier. The filter rod length in each case was 20 mm, and its circumference about 25 mm.

Examples 1 and 2 were conducted using a 2.5/45,000 denier cellulose acetate tow which was gathered to tubular form over a mandrel through which the three activated carbon-carrying threads were supplied to form a core.

In Example 3 the same cellulose acetate tow as in Examples 1 and 2 was gathered to rod form without a central mandrel, but with simultaneous entrainment of the three activated carbon-carrying threads.

Examples 4 to 6 were performed in similar manner to Example 3, but with the substition of creped paper for the cellulose acetate tow, the packing of the paper being such as to give a different rod pressure drop in each case.

The following Table sets out the pressure drop and total carbon loading of each filter together with its percentage retention for various vapour phase components, when tested in conjunction with a standard cigarette on a standard smoking machine under standard conditions.

TABLE

| EXAMPLE No. | Tip PD (mm) | Carbon Loading (mg) | % Retention | | | | |
|---|---|---|---|---|---|---|---|
| | | | Acetaldehyde | Acrolein | Acetone | Isoprene | Toluene |
| 1 | 52 | 92 | 8.5 | 16.9 | 46.6 | 16.9 | 62.9 |
| 2 | 48 | 81.5 | 9.3 | 29.4 | 43.7 | 16.3 | 63.7 |
| 3 | 102 | 96 | 11.4 | 38.0 | 48.6 | 25.4 | 69.2 |
| 4 | 22 | 76 | 14.4 | 34.9 | 47.1 | 28.3 | 50.8 |
| 5 | 72 | 84 | 29.3 | 47.2 | 53.2 | 45.6 | 74.4 |
| 6 | 110 | 85 | 35.4 | 49.7 | 60.7 | 45.6 | 79.3 |

The pressure drops in the Table were measured "totally enclosed"—i.e. with only the end faces exposed—under standard air flow conditions and are expressed in mm Wg (water gauge).

EXAMPLE 7

This Example used Sutcliffe Speakman 208C activated carbon of 12/30 British Standard mesh size. Five textile threads, each of about 1000 denier, were coated with the carbon by means of adhesive on the threads, the mean coating weight per thread being about 1.5 mg/mm. The five threads were first coated with a PVA type adhesive by passing them through a bath of the liquid adhesive, with doctoring to give a controlled even coating of the adhesive; following this the threads were drawn simultaneously longitudinally through a reservoir of the carbon whilst the adhesive was still active, to pick up a carbon coating. In the same continuous in-line process, the resulting five carbon coated threads were gathered and wrapped in Ecusta Heat Seal perforated plugwrap by means of a conventional garniture, and the resulting wrapped core was passed through a central mandrel of a garniture, with 3.3/32,000 denier filamentary cellulose acetate tow being gathered to tubular form around the wrapped core from the mandrel to continuously form a composite filter rod; this rod was cut, as it was formed, into finite length. The totally enclosed pressure drop of this composite filter was about 2 mm.Wg per mm.length. Lengths (12 mm.) of this composite filter (enclosed pressure drop about 23 mm.Wg) were made into multiple filters, the 12 mm.length being abutted end to end between two 6 mm.lengths of NWA filter (unwrapped, bonded cellulose acetate filamentary tow) and this assembly being wrapped in a conventional plugwrap.

The multiple filter was 24 mm.long×24.4 mm. circumference and had an enclosed pressure drop of 85 mm.Wg and gave the following vapour phase retentions:

| | |
|---|---|
| Acetaldehyde | 27.6% |
| Acrolein | 49.4% |
| Acetone | 49.3% |
| Isoprene | 31.7% |
| Toluene | 54.1% |

We claim:

1. A method of forming a tobacco smoke filter which comprises: (a) providing tobacco smoke filtering material; (b) coating at least one thread or strip which is separate and distinct from said filtering material with a predetermined quantity of an insoluble solvent particulate additive; and (c) entraining and gathering said thread(s) or strip(s) into said filtering material.

2. A method according to claim 1 wherein a plurality of said additive-coated thread(s) and/or strip(s) is first gathered together to form a core separate from the filtering material, and then entrained and gathered with the filtering material.

3. A method according to claim 1 in which at least the steps of coating said thread(s) and/or strip(s) with particulate additive, and gathering said additive-carrying thread(s) and/or strip(s) with other smoke filtering material into rod or tubular form, are conducted in a continuous in-line operation.

4. A method according to claim 1 which includes drawing said thread(s) and/or strip(s) through a supply of liquid adhesive and then through a supply of the particulate additive whilst said adhesive is still active.

5. A method according to claim 1 wherein a plurality of said additive-coated thread(s) and/or strip(s) is first gathered together to form a core separate from said filtering material and separately bound before being entrained and gathered in the filtering material.

6. A tobacco smoke filter comprising a rod of conventional tobacco smoke filtering material incorporating particulate adhesively bound additive onto from 1–10 thread(s) and/or strip(s) dispersed throughout or gathered within the remaining body of filtering material and distinct from said filter material wherein said adhesively bound additive is selected from the group comprising: activated carbon, silica gel, sepiolite, alumina, and ion exchangers.

7. A tobacco smoke filter comprising:

(a) smoke filtering material;

(b) at least one separate thread or strip extending through and distinct from said filtering material; and (c) an additive consisting of a predetermined quantity of an insoluble sorbent particulate material being adhesively fastened to said at least one thread or strip.

8. A filter according to claim 7 wherein all said particulate additive is on said thread(s) and/or strip(s).

9. A filter according to claim 7 wherein said at least one thread and/or strip is substantially uniformly coated with said particulate additive.

10. A filter according to claim 7 having a plurality of said additive-carrying threads and/or strips gathered together to form a core which is separate from said filtering material.

11. A filter according to claim 10 wherein a said core is bounded by a sleeve within and separate from said filtering material.

12. A filter according to claim 7 wherein at least one said thread and/or strip has a different particulate coating from another said thread and/or strip.

* * * * *

UNITED STATES PATENT AND TRADEMARK OFFICE

CERTIFICATE OF CORRECTION

PATENT NO. : 5,012,828

DATED : May 7, 1991

INVENTOR(S) : Ernest B. Hayes, et al.

It is certified that error appears in the above-identified patent and that said Letters Patent is hereby corrected as shown below:

On the Title Page, after Section [76] and before Section [21] add the following:

-- [73] Assignee: 501 Cigarette Components Limited
Stoke House, Stoke Poges, SLough,
SL2 4JN United Kingdom --

Signed and Sealed this

Ninth Day of February, 1993

*Attest:*

STEPHEN G. KUNIN

*Attesting Officer*

*Acting Commissioner of Patents and Trademarks*